US009640125B2

(12) United States Patent
Xu

(10) Patent No.: US 9,640,125 B2
(45) Date of Patent: May 2, 2017

(54) SYSTEMS AND METHODS FOR TRANSMITTING DATA USING PHASE SHIFT MODULATION IN DISPLAY SYSTEMS

(71) Applicants: BOE TECHNOLOGY GROUP CO., LTD., Beijing (CN); BEIJING BOE DISPLAY TECHNOLOGY CO., LTD., Beijing (CN)

(72) Inventor: Yizhen Xu, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/445,702

(22) Filed: Jul. 29, 2014

(65) Prior Publication Data

US 2015/0255032 A1 Sep. 10, 2015

(30) Foreign Application Priority Data

Mar. 6, 2014 (CN) ..... 2014 1 0081047

(51) Int. Cl.
*G09G 3/36* (2006.01)

(52) U.S. Cl.
CPC ..... *G09G 3/3648* (2013.01); *G09G 3/3688* (2013.01); *G09G 2310/08* (2013.01); *G09G 2370/08* (2013.01)

(58) Field of Classification Search
None
See application file for complete search history.

(56) References Cited

U.S. PATENT DOCUMENTS

2009/0079477 A1* 3/2009 Lee ..... H03L 7/089 327/149
2009/0079719 A1* 3/2009 Lee ..... G09G 3/20 345/204

(Continued)

FOREIGN PATENT DOCUMENTS

CN 1684128 A 10/2005
CN 102739585 A 10/2012

(Continued)

OTHER PUBLICATIONS

First Office Action regarding Chinese application No. 201410081047.5, dated Aug. 5, 2015. Translation provided by Dragon Intellectual Property Law Firm.

*Primary Examiner* — David D Davis
(74) *Attorney, Agent, or Firm* — Harness, Dickey & Pierce, P.L.C.

(57) ABSTRACT

The present disclosure provides methods for transmitting data in a display system, a clock controller, a source driver, and a display system. The method includes the steps of: receiving, by the clock controller, a reference clock signal and a data signal from an external data source; determining a phase difference between the data signal and the reference clock signal in each cycle; encoding the determined phase difference to generate a corresponding encoded signal; and transmitting the encoded signal and the reference clock signal to the source driver. By encoding the phase difference between the data signal and the reference clock signal in each cycle, it is able to use the encoded signal and the reference clock signal to transmit the data signal and the reference clock signal between the clock controller and the source driver.

18 Claims, 7 Drawing Sheets

(56) References Cited

U.S. PATENT DOCUMENTS

| | | | | |
|---|---|---|---|---|
| 2011/0199368 | A1 | 8/2011 | Huang et al. | |
| 2012/0162282 | A1* | 6/2012 | Pyeon | G09G 3/20 345/690 |

FOREIGN PATENT DOCUMENTS

| | | | |
|---|---|---|---|
| CN | 103218981 | A | 7/2013 |
| KR | 2011-0130209 | A | 12/2011 |

* cited by examiner

SYSTEMS AND METHODS FOR TRANSMITTING DATA USING PHASE SHIFT MODULATION IN DISPLAY SYSTEMS

CROSS-REFERENCE TO RELATED APPLICATION

This application claims priority to Chinese Patent Application No. 201410081047.5 filed on Mar. 6, 2014, the disclosure of which is incorporated in its entirety by reference herein.

TECHNICAL FIELD

The present disclosure relates to the field of display technology, in particular to methods for transmitting data in a display device, a clock controller, a source driver, and a display system.

BACKGROUND

An active matrix liquid crystal display uses a thin film transistor as a switch element so as to display an image. Due to its features such as being thin, light and of low power consumption, the active matrix liquid crystal display has been widely used in such display devices as computer monitors, notebook computers, portable terminals and wall-mounted TVs.

Generally, a liquid crystal display includes a liquid crystal display panel, a plurality of source drivers (also called source driving integrated circuits) for providing data signals and clock control signals to data lines of the liquid crystal display panel, and a clock controller for controlling the source drivers.

For an existing liquid crystal display, usually digital video data from an external signal source, such as the data signals and the clock control signals, is input into the clock controller via an interface, then the data signals and the clock control signals are transmitted to the source drivers by the clock controller via such an interface as miniature low voltage differential signal (mini-LVDS) interface, and finally the received data signals and the clock control signals are transmitted by the source drivers to the data lines, so as to display the image.

The clock controller transmits the data signals and the clock control signals to the source drivers via the mini-LVDS interface. Because the mini-LVDS interface transmits the clock control signals and the data signals in the form of a pair of differential signals with different phases, at least 14 signal lines are required to be arranged between the clock controller and the respective source drivers. As shown in FIG. 1, there are seven pairs of signal lines between the clock controller 01 and the respective source drivers 02. Among these signal lines, six pairs of signal lines, i.e., ML0 to ML5, are used to transmit the data signals, while the pair of signal lines, i.e., CLK0, is used to transmit the clock control signals. As a result, a large region is required to be provided on a printing circuit board (PCB) between the clock controller and the source drivers so that these signal lines can be arranged thereon.

Hence, there is an urgent need for a novel method for transmitting data between the clock controller and the source drivers.

SUMMARY

An object of the present disclosure is to provide methods for transmitting data in a display system, a clock controller, a source driver, and the display system, so as to provide a novel method for transmitting the data between the clock controller and the source driver in the display system.

In one aspect, the present disclosure provides a method for transmitting data in a display system. The method includes the following steps: receiving, by a clock controller in the display system, a reference clock signal and a data signal from an external data source; determining, by the clock controller, a phase difference between the data signal and the reference clock signal in each cycle; encoding, by the clock controller, the determined phase difference according to a predetermined mapping table between phase differences and encoded signals, so as to generate a corresponding encoded signal; and transmitting, by the clock controller, the encoded signal and the reference clock signal to a source driver in the display system.

According to the method for transmitting the data in the display system, the clock controller receives the reference clock signal and the data signal from the external data source, determines the phase difference between the data signal and the reference clock signal in each cycle, encodes the determined phase difference according to the predetermined mapping table between phase differences and encoded signals so as to generate the corresponding encoded signal, and then transmits the encoded signal and the reference clock signal to the source driver. By encoding the phase difference between the data signal and the reference clock signal in each cycle, it is able to use the encoded signal and the reference clock signal to transmit the data signal and the reference clock signal between the clock controller and the source driver. Meanwhile, as compared with the data signal in the prior art, the amount of data in the encoded signal is relatively small, so it is able to transmit the data with few signal lines arranged between the clock controller and the source drivers, to reduce a wiring area on a PCB and reduce the production cost.

Alternatively, in order to facilitate the implementation, the predetermined mapping table between phase differences and encoded signals is established by dividing one cycle into $2^N$ equal intervals, N being a positive integer greater than 0; and causing the phase difference in the respective interval to correspond to an encoded signal consisting of N numbers, the encoded signals corresponding to the phase differences in the respective intervals being different from each other.

Alternatively, in order to facilitate the implementation, the step of dividing one cycle into $2^N$ equal intervals includes dividing the cycle into 4 equal intervals. The step of causing the phase difference in the respective interval to correspond to the encoded signal consisting of N numbers includes defining the encoded signal corresponding to the phase difference in a first interval as (0,0); defining the encoded signal corresponding to the phase difference in a second interval as (0,1); defining the encoded signal corresponding to the phase difference in a third interval as (1,0); and defining the encoded signal corresponding to the phase difference in a fourth interval as (1,1).

Alternatively, in order to reduce the wiring area on the PCB, the step of transmitting, by the clock controller, the encoded signal and the reference clock signal to the source driver in the display system includes the following: when the reference clock signal has a frequency less than a predetermined frequency, transmitting, by the clock controller, the encoded signal and the reference clock signal to the source driver in electrical connection with the clock controller via a pair of signal lines, respectively.

Alternatively, in order to reduce the wiring area on the PCB, the step of transmitting, by the clock controller, the encoded signal and the reference clock signal to the source driver in the display system includes the following: when the reference clock signal has a frequency greater than the predetermined frequency, packaging, by the clock controller, the encoded signal to generate a first set of differential signals; transmitting the first set of differential signals to the source driver in electrical connection with the clock controller via a pair of signal lines; packaging the reference clock signal to generate a second set of differential signals; and transmitting the second set of differential signals to the source driver in electrical connection with the clock controller via another pair of signal lines.

In another aspect, the present disclosure provides a method for transmitting data in a display system. The method includes the following steps: receiving, by a source driver in the display system, a reference clock signal and an encoded signal encoded according to a phase difference between a data signal and the reference clock signal in each cycle from a clock controller; decoding, by the source driver, the encoded signal according to a predetermined mapping table between phase differences and encoded signals, to generate the phase difference corresponding to the encoded signal; generating, by the source driver, a data signal according to the phase difference and the reference clock signal; and transmitting, by the source driver, the data signal and the reference clock signal to a data line in the display system.

According to the method for transmitting the data in the display system, the source driver receives the reference clock signal from the clock controller and the encoded signal encoded according to the data signal and the reference clock signal in each cycle, decodes the encoded signal according to the predetermined mapping table between phase differences and encoded signals so as to generate the phase difference corresponding to the encoded signal, generates the data signal according to the phase difference and the reference clock signal, and transmits the data signal and the reference clock signal to the data line in the display system, so as to display an image. By decoding the received encoded signal to generate the phase difference between the data signal and the reference clock signal in each cycle and generating the data signal according to the phase difference and the reference clock signal, it is able to transmit the data signal and the reference clock signal between the clock controller and the source driver. Meanwhile, as compared with the data signal transmitted from the clock controller in the prior art, the amount of data in the encoded signal transmitted from the clock controller to the source driver is small, so it is able to transmit the data with few signal lines arranged between the clock controller and the source drivers, to reduce a wiring area on a PCB and reduce the production cost.

Alternatively, in order to reduce the wiring area on the PCB, the step of receiving, by the source driver, the reference clock signal and the encoded signal from the clock controller includes the following: when the reference clock signal has a frequency less than a predetermined frequency, receiving, by the source driver, the encoded signal and the reference clock signal from the clock controller in electrical connection with the source driver via a pair of signal lines, respectively.

Alternatively, in order to reduce the wiring area on the PCB, the step of receiving, by the source driver, the reference clock signal and the encoded signal from the clock controller includes the following: when the reference clock signal has a frequency greater than the predetermined frequency, receiving, by the source driver, a first set of differential signals generated by packaging the encoded signal, which is encoded according to the phased difference between the data signal and the reference clock signal in each cycle, via a pair of signal lines; unpackaging the first set of differential signals to obtain the encoded signal; receiving a second set of differential signals generated by packaging the reference clock signal from the clock controller via another pair of signal lines; and unpackaging the second set of differential signals to obtain the reference clock signal.

In yet another aspect, the present disclosure provides a clock controller, including the following: a receiving unit configured to receive a reference clock signal and a data signal from an external data source; a determining unit configured to determine a phase difference between the data signal and the reference clock signal in each cycle; an encoding unit configured to encode the determined phase difference according to a predetermined mapping table between phase differences and encoded signals, so as to generate a corresponding encoded signal; and a transmitting unit configured to transmit the encoded signal and the reference clock signal to a source driver.

Alternatively, in order to facilitate the implementation, the clock controller further includes a storage unit configured to store the mapping table between phase differences and encoded signals. The predetermined mapping table between phase differences and encoded signals is established by dividing one cycle into $2^N$ equal intervals, N being a positive integer greater than 0; and causing the phase difference in the respective interval to correspond to an encoded signal consisting of N numbers, the encoded signals corresponding to the phase differences in the respective intervals being different from each other.

Alternatively, in order to reduce the wiring area on the PCB, the transmitting unit is specifically configured to, when the reference clock signal has a frequency less than a predetermined frequency, transmit the encoded signal and the reference clock signal to the source driver in electrical connection with the clock controller via a pair of signal lines, respectively.

Alternatively, in order to reduce the wiring area on the PCB, the transmitting unit is specifically configured to, when the reference clock signal has a frequency greater than the predetermined frequency, package the encoded signal to generate a first set of differential signals, transmit the first set of differential signals to the source driver in electrical connection with the clock controller via a pair of signal lines, package the reference clock signal to generate a second set of differential signals, and transmit the second set of differential signals to the source driver in electrical connection with the clock controller via another pair of signal lines.

In yet another aspect, the present disclosure provides a source driver, including the following: a receiving unit configured to receive a reference clock signal and an encoded signal encoded according to a phase difference between a data signal and the reference clock signal in each cycle from a clock controller; a decoding unit configured to decode the encoded signal according to a predetermined mapping table between phase differences and encoded signals, to generate the phase difference corresponding to the encoded signal; a generating unit configured to generate a data signal according to the phase difference and the reference clock signal; and a transmitting unit configured to transmit the data signal and the reference clock signal to a data line.

Alternatively, in order to reduce the wiring area on the PCB, the receiving unit is specifically configured to, when the reference clock signal has a frequency less than a predetermined frequency, receive the encoded signal and the reference clock signal from the clock controller in electrical connection with the source driver via a pair of signal lines, respectively.

Alternatively, in order to reduce the wiring area on the PCB, the receiving unit is specifically configured to, when the reference clock signal has a frequency greater than the predetermined frequency, receive a first set of differential signals generated by packaging the encoded signal, which is encoded according to the phased difference between the data signal and the reference clock signal in each cycle, via a pair of signal lines; unpackage the first set of differential signals to obtain the encoded signal; receive a second set of differential signals generated by packaging the reference clock signal from the clock controller via another pair of signal lines; and unpackage the second set of differential signals to obtain the reference clock signal.

In yet another aspect, the present disclosure provides a display system including a clock controller and at least one source driver. The clock controller is configured to receive a reference clock signal and a data signal from an external data source; determine a phase difference between the data signal and the reference clock signal in each cycle; encode the determined phase difference according to a predetermined mapping table between phase differences and encoded signals, so as to generate a corresponding encoded signal; and transmit the encoded signal and the reference clock signal to the source driver. The source driver is configured to receive a reference clock signal and an encoded signal encoded according to a phase difference between a data signal and the reference clock signal in each cycle from a clock controller; decode the encoded signal according to a predetermined mapping table between phase differences and encoded signals, to generate the phase difference corresponding to the encoded signal; generate a data signal according to the phase difference and the reference clock signal; and transmit the data signal and the reference clock signal to a data line.

According to the display system of the present disclosure, the clock controller receives the data signal and the reference clock signal from the external data source, encodes the phase difference between the data signal and the reference clock signal in each cycle to generate the corresponding encoded signal, and finally transmits the encoded signal and the reference clock signal to the source driver. The source driver decodes the received encoded signal to generate the corresponding phase difference between the data signal and the reference clock signal, generates the data signal according to the phase difference and the reference clock signal, and finally transmits the generated data signal and the reference clock signal to the data line. As a result, it is able to transmit the data signal and the reference clock signal between the clock controller and the source driver in the display system, to display an image by the display system. Meanwhile, in the display system, the encoded signal is transmitted between the clock controller and the source driver through the encoded signal, and as compared with the data transmission directly using the data signal in the prior art, the amount of data in the encoded signal is small. Hence, for the display system of the present disclosure, it is able to transmit the data with few signal lines between the clock controller and the source driver, to reduce the wiring area on the PCB and reduce the production cost.

Alternatively, in order to reduce the wiring area on the PCB, when the reference clock signal has a frequency less than a predetermined frequency, the display system further includes a pair of signal lines located between the respective source driver and the clock controller. The clock controller is specifically configured to transmit the encoded signal and the reference clock signal to the source driver in electrical connection with the clock controller via the pair of signal lines, respectively. The source driver is specifically configured to receive the encoded signal and the reference clock signal from the clock controller in electrical connection with the source driver via the pair of signal lines, respectively.

Alternatively, in order to reduce the wiring area on the PCB, when the reference clock signal has a frequency greater than the predetermined frequency, the display system further includes two pairs of signal lines located between the respective source driver and the clock controller. The clock controller is specifically configured to package the encoded signal to generate a first set of differential signals, transmit the first set of differential signals to the source driver in electrical connection with the clock controller via a pair of signal lines, package the reference clock signal to generate a second set of differential signals, and transmit the second set of differential signals to the source driver in electrical connection with the clock controller via another pair of signal lines. The source driver is configured to receive the first set of differential signals generated by packaging the encoded signal, which is encoded according to the phase difference between the data signal and the reference clock signal in each cycle, via a pair of lines, and unpackage the first set of differential signals to obtain the encoded signal, receive the second set of differential signals generated by packaging the reference clock signal from the clock controller via another pair of signal lines, unpackage the second set of differential signals to obtain the reference clock signal.

DETAILED DESCRIPTION

The present disclosure will be described hereinafter in conjunction with the drawings.

Figure 2:
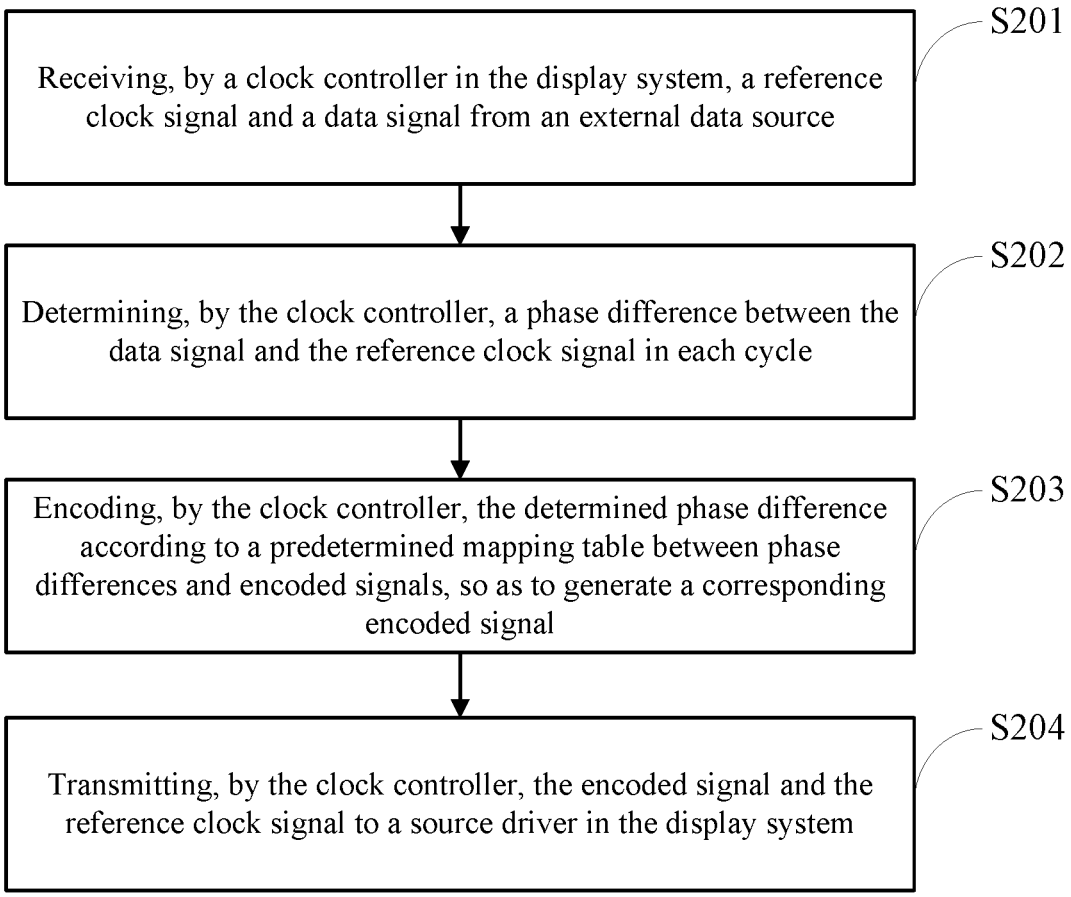
FIG. 2 is a flow chart of a method for transmitting data at a clock controller side according to one embodiment of the present disclosure.

As shown in FIG. 2, a method for transmitting data in a display system at a clock controller side includes the following steps: receiving, by a clock controller in the display system, a reference clock signal and a data signal from an external data source (S201); determining, by the clock controller, a phase difference between the data signal and the reference clock signal in each cycle (S202); encoding, by the clock controller, the determined phase difference according to a predetermined mapping table between phase differences and encoded signals, so as to generate a corresponding encoded signal (S203); and transmitting, by the clock controller, the encoded signal and the reference clock signal to a source driver in the display system (S204).

According to the method for transmitting the data in the display system, the clock controller receives the reference clock signal and the data signal from the external data source, determines the phase difference between the data signal and the reference clock signal in each cycle, encodes the determined phase difference according to the predetermined mapping table between phase differences and encoded signals so as to generate the corresponding encoded signal, and then transmits the encoded signal and the reference clock signal to the source driver. By encoding the phase difference between the data signal and the reference clock signal in each cycle, it is able to use the encoded signal and the reference clock signal to transmit the data signal and the reference clock signal between the clock controller and the source driver. Meanwhile, as compared with the data signal in the prior art, the amount of data in the encoded signal is relatively small, so it is able to transmit the data with few signal lines arranged between the clock controller and the source driver, to reduce a wiring area on a PCB and reduce the production cost.

Figure 3:
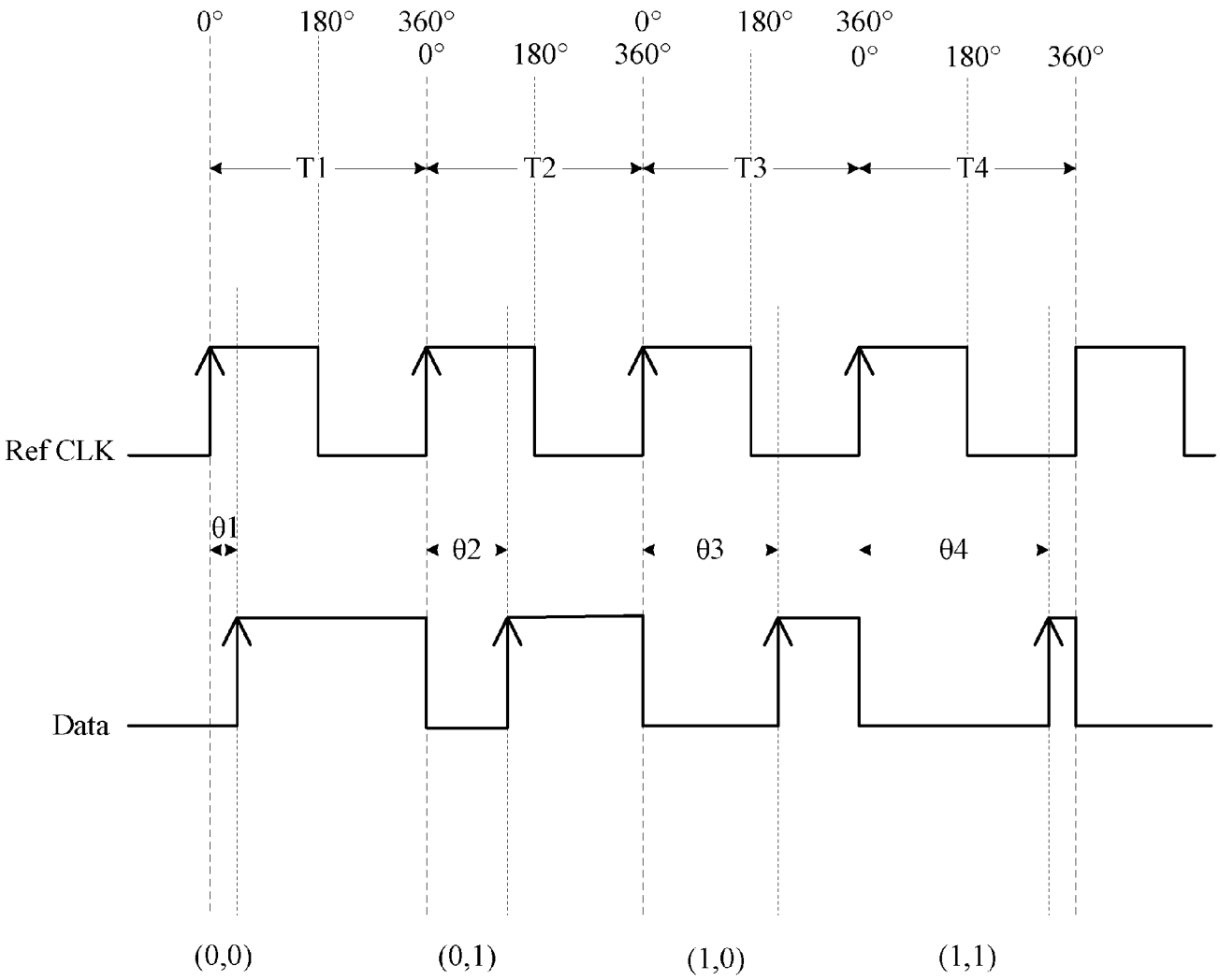
FIG. 3 is a time sequence diagram of a data signal and a reference clock signal according to one embodiment of the present disclosure.

It is to be noted that, in this method, the phase difference between the data signal and the reference clock signal in each cycle refers to a phase difference between a first rising edge of the reference clock signal and a first rising edge of the data signal in each cycle of the reference clock signal. For example, as shown in FIG. 3, in a cycle T1 of a reference clock signal Ref CLK, the phase difference between the first rising edge of the reference clock signal Ref CLK and the first rising edge of the data signal Data is θ1; in a cycle T2 of the reference clock signal Ref CLK, the phase difference between the first rising edge of the reference clock signal Ref CLK and the first rising edge of the data signal Data is θ2; in a cycle T3 of the reference clock signal Ref CLK, the phase difference between the first rising edge of the reference clock signal Ref CLK and the first rising edge of the data signal Data is θ3; and in a cycle T4 of the reference clock signal Ref CLK, the phase difference between the first rising edge of the reference clock signal Ref CLK and the first rising edge of the data signal Data is θ4.

Alternatively, the predetermined mapping table between phase differences and encoded signals is established by the following steps: dividing one cycle into $2^N$ equal intervals, N being a positive integer greater than 0; and causing the phase difference in the respective interval to correspond to an encoded signal consisting of N numbers, the encoded signals corresponding to the phase differences in the respective intervals being different from each other.

To be specific, during the implementation, a cycle is usually 2π or 360°, which is not particularly defined herein.

Alternatively, the step of dividing one cycle into $2^N$ equal intervals includes: dividing one cycle into 4 equal intervals, e.g., dividing a cycle of 360° into 4 equal intervals, i.e., 0° to 90°, 90° to 180°, 180° to 270°, and 270° to 360°.

The step of causing the phase difference in the respective interval to correspond to the encoded signal consisting of N numbers includes the following steps: defining the encoded signal corresponding to the phase difference in a first interval as (0,0), e.g., defining the encoded signal corresponding to the phase difference in the interval 0° to 90° as (0,0), or as shown in FIG. 3 where 0°<θ1<90°, defining the encoded signal corresponding to θ1 as (0,0); defining the encoded signal corresponding to the phase difference in a second interval as (0,1), e.g., defining the encoded signal corresponding to the phase difference in the interval 90° to 180° as (0,1), or as shown in FIG. 3 where 90°<θ2<180°, defining the encoded signal corresponding to θ2 as (0,1); defining the encoded signal corresponding to the phase difference in a third interval as (1,0), e.g., defining the encoded signal corresponding to the phase difference in the interval 180° to 270° as (1,0), or as shown in FIG. 3 where 180°<θ3<270°, defining the encoded signal corresponding to θ3 as (1,0); and defining the encoded signal corresponding to the phase difference in a fourth interval as (1,1), e.g., defining the encoded signal corresponding to the phase difference in the interval 270° to 360° as (1,1), or as shown in FIG. 3 where 270°<θ4<360°, defining the encoded signal corresponding to θ4 as (1,1).

Figure 1:
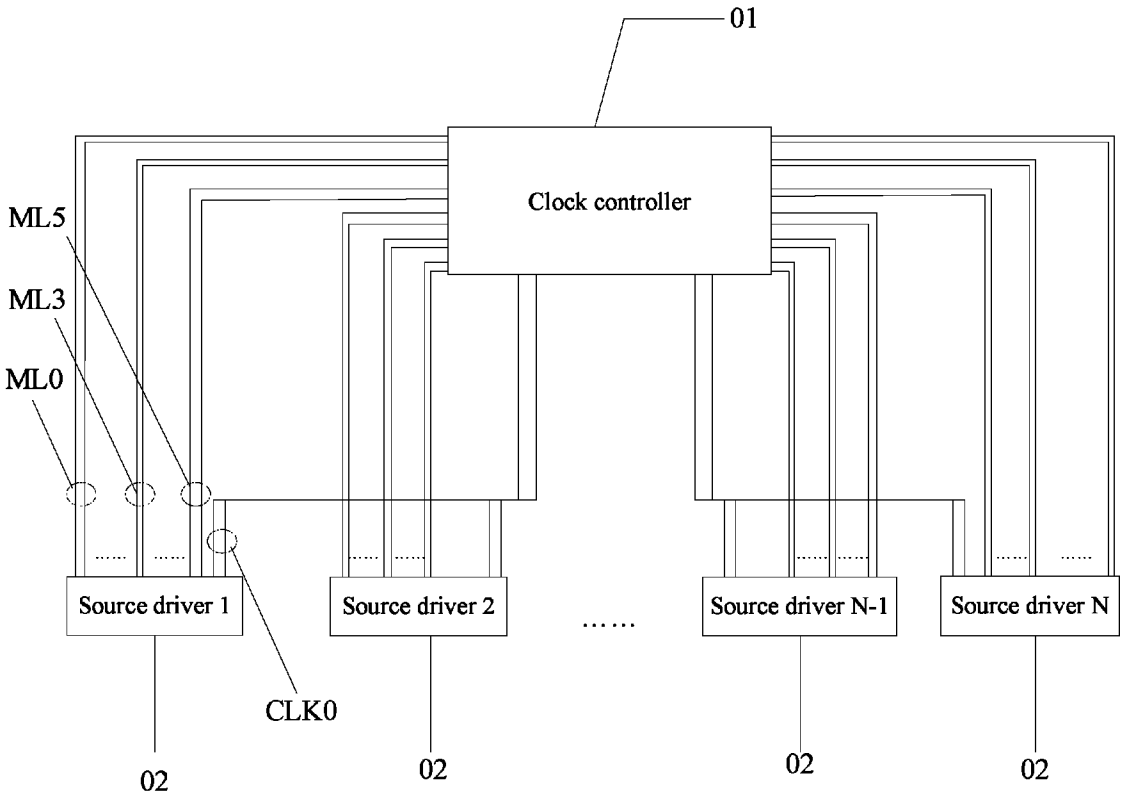
FIG. 1 Prior Art
FIG. 1 is a schematic diagram showing an existing liquid crystal display.
Figure 7A:
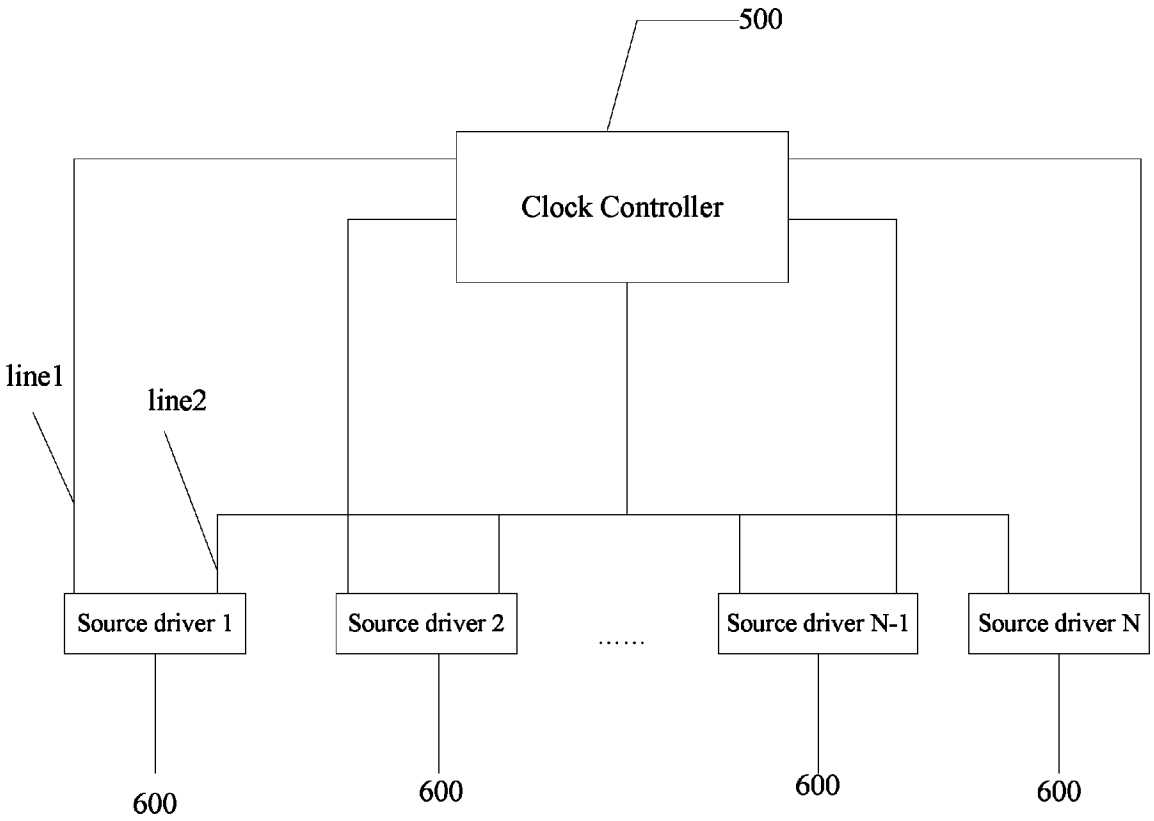
FIG. 7*a* is a schematic view showing a structure of a display system when a reference clock signal has a frequency less than a predetermined frequency according to one embodiment of the present disclosure.

Alternatively, as shown in FIG. 7*a*, step S204 of transmitting, by the clock controller, the encoded signal and the reference clock signal to the source driver in the display system includes the following steps: when the reference clock signal has a frequency less than the predetermined frequency, transmitting, by the clock controller 500, the encoded signal and the reference clock signal to the source driver 600 in electrical connection with the clock controller 500 via a pair of signal lines Line1 and Line2, respectively. The signal Line1 is configured to transmit the encoded signal to the source driver 600 in electrical connection with the clock controller 500, while the signal line Line2 is configured to transmit the reference clock signal to the source driver 600 in electrical connection with the clock controller 500. In other words, in the method of this embodiment, merely two signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the method of this embodiment may reduce the number of lines on the PCB, to reduce the production cost.

To be specific, during the implementation, the predetermined frequency is usually 65 MHz, which is not particularly defined herein.

Figure 7B:
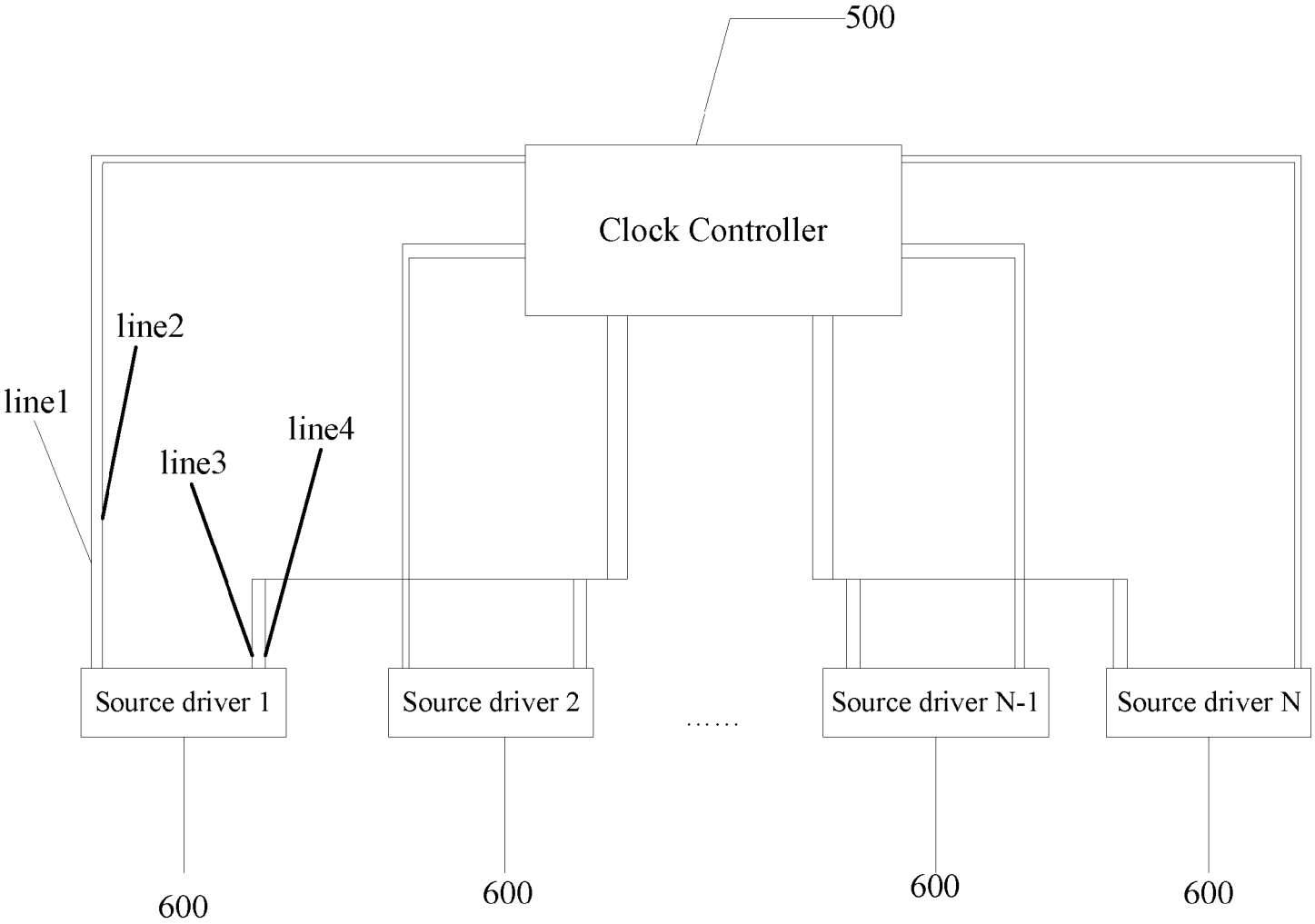
FIG. 7*b* is a schematic view showing a structure of the display system when the reference clock signal has a frequency greater than the predetermined frequency according to one embodiment of the present disclosure.

Alternatively, as shown in FIG. 7*b*, step S204 of transmitting, by the clock controller, the encoded signal and the reference clock signal to the source driver in the display system includes the following steps: when the reference clock signal has a frequency greater than the predetermined frequency, in order to avoid signal offset such as delay and skew signal on the wiring of PCB, packaging, by the clock controller 500, the encoded signal to generate a first set of differential signals; transmitting the first set of differential signals to the source drive 600 in electrical connection with the clock controller 500 via a pair of signal lines Line1 and Line 2; packaging the reference clock signal to generate a second set of differential signals; and transmitting the second set of differential signals to the source driver 600 in electrical connection with the clock controller 500 via another pair of signal lines Line3 and Line4. In other words, in the method of this embodiment, merely four signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the method of this embodiment can reduce the number of lines on the PCB, to reduce the production cost.

Figure 4:
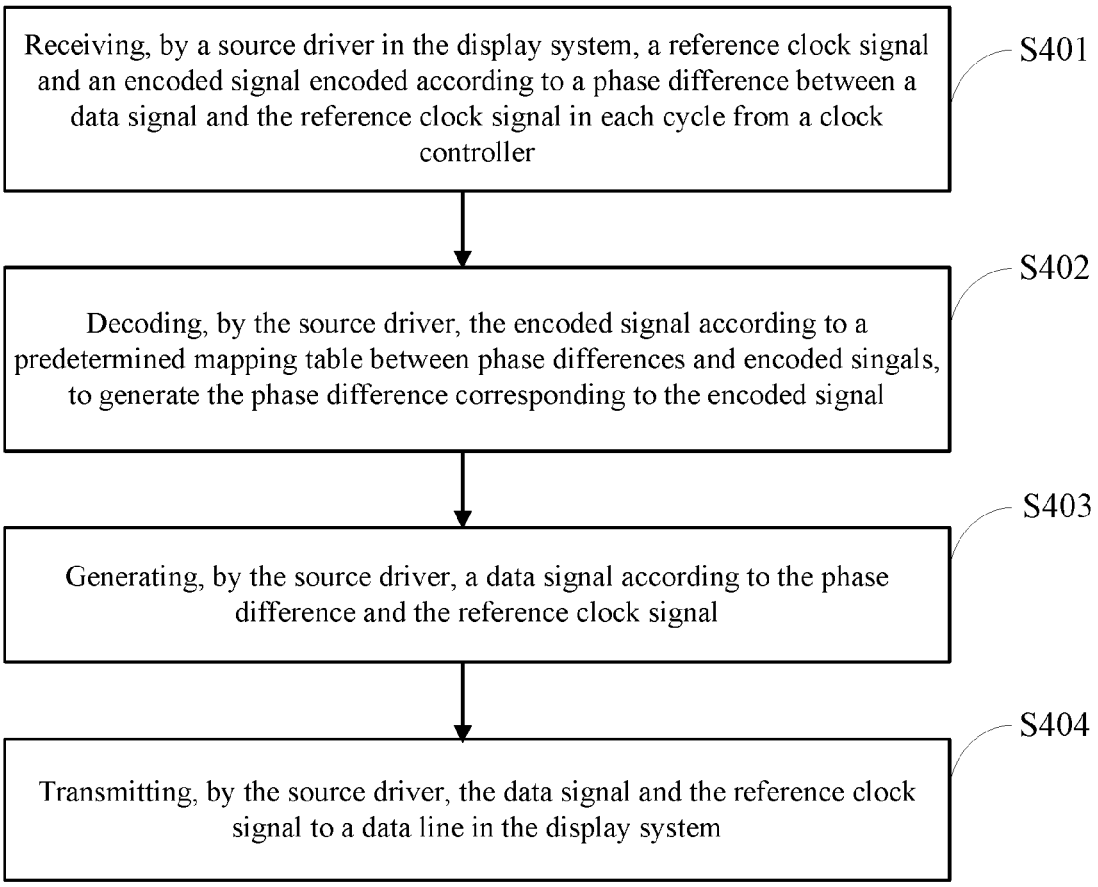
FIG. 4 is a flow chart of a method for transmitting data at a source driver side according to one embodiment of the present disclosure.

Based on an identical inventive concept, as shown in FIG. 4, a method for transmitting data in a display system at a source driver side includes the following steps: receiving, by a source driver in the display system, a reference clock signal and an encoded signal encoded according to a phase difference between a data signal and the reference clock signal in each cycle from a clock controller (S401); decoding, by the source driver, the encoded signal according to a predetermined mapping table between phase differences and encoded signals, to generate the phase difference corresponding to the encoded signal (S402); generating, by the source driver, a data signal according to the phase difference and the reference clock signal (S403); and transmitting, by the source driver, the data signal and the reference clock signal to a data line in the display system (S404).

According to the above method for transmitting the data in the display system, the source driver receives the reference clock signal from the clock controller and the encoded signal encoded according to the data signal and the reference clock signal in each cycle, decodes the encoded signal according to the predetermined mapping table between phase differences and encoded signals so as to generate the phase difference corresponding to the encoded signal, generates the data signal according to the phase difference and the reference clock signal, and transmits the data signal and the reference clock signal to the data line in the display system, so as to display an image. By decoding the received encoded signal to generate the phase difference between the data signal and the reference clock signal in each cycle, and generating the data signal according to the phase difference and the reference clock signal, it is able to transmit the data signal and the reference clock signal between the clock controller and the source driver. Meanwhile, as compared with the data signal from the clock controller in the prior art, the amount of data in the encoded signal transmitted from the clock controller to the source driver is small, so it is able to transmit the data with few signal lines arranged between the clock controller and the source driver, to reduce a wiring area on a PCB and reduce the production cost.

Alternatively, as shown in FIG. 7*a*, step S401 of receiving, by the source driver, the reference clock signal and the encoded signal from the clock controller includes the following steps: when the reference clock signal has a frequency less than a predetermined frequency, receiving, by the source driver 600, the encoded signal and the reference clock signal from the clock controller 500 in electrical connection with the source driver 600 via a pair of signal lines Line1 and Line2, respectively. The signal line Line1 is configured to receive the encoded signal from the clock controller 500 in electrical connection with the source driver 600, while the signal line Line2 is configured to receive the reference clock signal from the clock controller 500 in electrical connection with the source driver 600. In other words, in the method of this embodiment, merely two signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the method of this embodiment can reduce the number of lines on the PCB, to reduce the production cost.

Alternatively, as shown in FIG. 7*b*, step S401 of receiving, by the source drivers, the reference clock signal and the encoded signal from the clock controller includes the following steps: when the reference clock signal has a frequency greater than the predetermined frequency, receiving, by the source driver 600, a first set of differential signals generated by packaging the encoded signal, which is encoded according to the phase difference between the data signal and the reference clock signal in each cycle, via a pair of signal lines Line1 and Line2, and unpackaging the first set of differential signals to obtain the encoded signal; receiving a second set of differential signals generated by packaging the reference clock signal from the clock controller 500 via another pair of signal lines Line3 and Line4, unpackaging the second set of differential signals to obtain the reference clock signal. In other words, in the method of this embodiment, merely four signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the method of this embodiment can reduce the number of lines on the PCB, to reduce the production cost.

Figure 5:
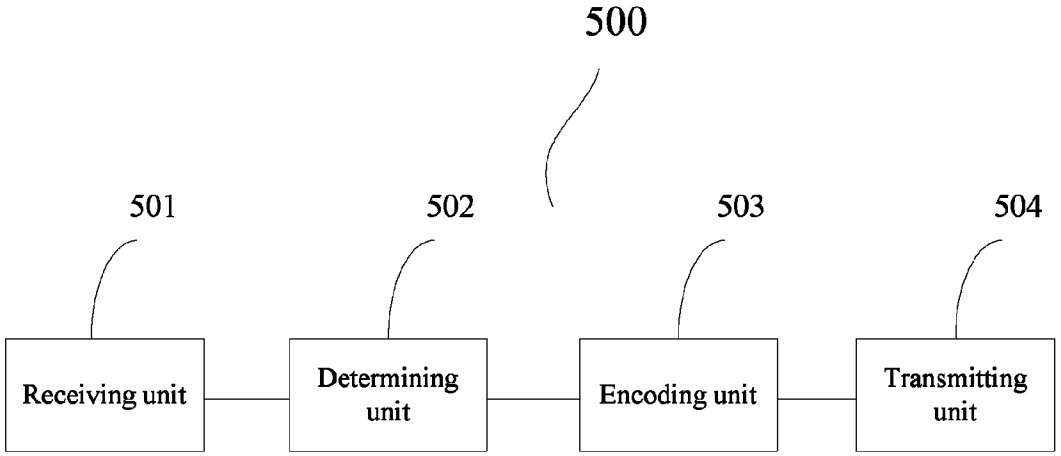
FIG. 5 is a schematic view showing a structure of a clock controller according to one embodiment of the present disclosure.

Based on an identical inventive concept, as shown in FIG. 5, the clock controller 500 includes the following: a receiving unit 501 configured to receive a reference clock signal and a data signal from an external data source; a determining unit 502 configured to determine a phase difference between the data signal and the reference clock signal in each cycle; an encoding unit 503 configured to encode the determined phase difference according to a predetermined mapping table between phase differences and encoded signals, so as to generate a corresponding encoded signal; and a transmitting unit 504 configured to transmit the encoded signal and the reference clock signal to source drivers.

Alternatively, the clock controller further includes a storage unit configured to store the mapping table between phase differences and encoded signals. The predetermined mapping table between the phase difference and the encoded signal is established by the steps of: dividing a cycle into $2^N$ equal intervals, N being a positive integer greater than 0; and causing the phase difference in the respective interval to correspond to an encoded signal consisting of N numbers, the encoded signals corresponding to the phase differences in the respective intervals being different from each other.

Alternatively, as shown in FIG. 7*a*, the transmitting unit is specifically configured to operate as follows: When the reference clock signal has a frequency less than the predetermined frequency, transmit the encoded signal and the reference clock signal to the source driver 600 in electrical connection with the clock controller 500 via a pair of signal lines Line1 and Line2, respectively. The signal Line1 is configured to transmit the encoded signal to the source driver 600 in electrical connection with the clock controller 500, while the signal line Line2 is configured to transmit the reference clock signal to the source driver 600 in electrical connection with the clock controller 500. In other words, for the clock controller of this embodiment, merely two signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the clock controller of this embodiment can reduce the number of lines on the PCB, to reduce the production cost.

Alternatively, as shown in FIG. 7*b*, the transmitting unit is specifically configured to operate as follows: When the reference clock signal has a frequency greater than the predetermined frequency, package the encoded signal to generate a first set of differential signals, transmit the first set of differential signals to the source drive 600 in electrical connection with the clock controller 500 via a pair of signal lines Line1 and Line 2, package the reference clock signal to generate a second set of differential signals, and transmit the second set of differential signals to the source driver 600 in electrical connection with the clock controller 500 via another pair of signal lines Line3 and Line4. In other words, for the clock controller of this embodiment, merely four signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the clock controller of this embodiment can reduce the number of lines on the PCB, to reduce the production cost.

Figure 6:
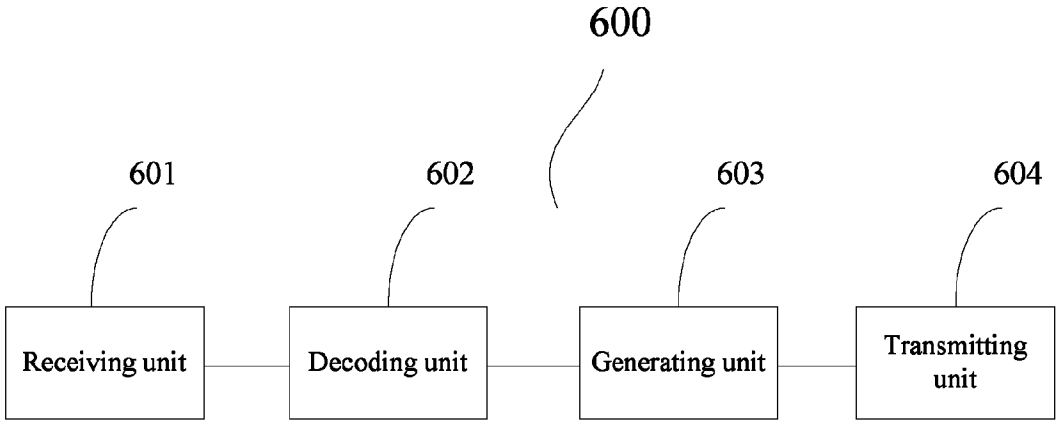
FIG. 6 is a schematic view showing a structure of a source driver according to one embodiment of the present disclosure.

Based on an identical inventive concept, as shown in FIG. 6, the source driver 600 includes the following: a receiving unit 601 configured to receive a reference clock signal and an encoded signal encoded according to a phase difference between a data signal and the reference clock signal in each cycle from a clock controller; a decoding unit 602 configured to decode the encoded signal according to a predetermined mapping table between phase differences and encoded signals, to generate the phase difference corresponding to the encoded signal; a generating unit 603 configured to generate a data signal according to the phase difference and the reference clock signal; and a transmitting unit 604 configured to transmit the data signal and the reference clock signal to a data line.

Alternatively, as shown in FIG. 7*a*, the receiving unit is specifically configured to operate as follows: When the reference clock signal has a frequency less than a predetermined frequency, receive the encoded signal and the reference clock signal from the clock controller 500 in electrical connection with the source driver 600 via a pair of signal lines Line1 and Line2, respectively. The signal line Line1 is configured to receive the encoded signal from the clock controller 500 in electrical connection with the source driver 600, while the signal line Line2 is configured to receive the reference clock signal from the clock controller 500 in electrical connection with the source driver 600. In other words, for the source driver of this embodiment, merely two signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the source driver of this embodiment can reduce the number of lines on the PCB, to reduce the production cost.

Alternatively, as shown in FIG. 7*b*, the receiving unit is specifically configured to operate as follows: When the reference clock signal has a frequency greater than the predetermined frequency, receive a first set of differential signals generated by packaging the encoded signal, which is encoded according to the phase difference between the data signal and the reference clock signal in each cycle, via a pair of signal lines Line1 and Line2, and unpackage the first set of differential signals to obtain the encoded signal; receive a second set of differential signals generated by packaging the reference clock signal from the clock controller 500 via another pair of signal lines Line3 and Line4, unpackage the second set of differential signals to obtain the reference clock signal. In other words, for the source driver of this embodiment, merely four signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the source driver of this embodiment can reduce the number of lines on the PCB, to reduce the production cost.

Based on an identical inventive concept, as shown in FIGS. 7*a* and 7*b*, a display system includes a clock controller 500 and at least one source driver 600.

The clock controller 500 is configured to receive a reference clock signal and a data signal from an external data source; determine a phase difference between the data signal and the reference clock signal in each cycle; encode the determined phase difference according to a predetermined mapping table between phase differences and encoded signals, so as to generate the corresponding encoded signal; and transmit the encoded signal and the reference clock signal to the source driver 600 respectively.

The source driver 600 is configured to receive a reference clock signal and an encoded signal encoded according to a phase difference between a data signal and the reference clock signal in each cycle from a clock controller 500; decode the encoded signal according to a predetermined mapping table between phase differences and encoded signals, to generate the phase difference corresponding to the encoded signal; generate a data signal according to the phase difference and the reference clock signal; and transmit the data signal and the reference clock signal to a data line.

According to the display system of the present disclosure, the clock controller receives the data signal and the reference clock signal from the external data source, encodes the phase difference between the data signal and the reference clock signal in each cycle to generate the corresponding encoded signal, and finally transmits the encoded signal and the reference clock signal to the source driver. The source driver decodes the received encoded signal to generate the phase difference between the data signal and the reference clock signal in each cycle corresponding to the encoded signal, generates the data signal according to the phase difference and the reference clock signal, and finally transmits the generated the data signal and the reference clock signal to the data line. As a result, it is able to transmit the data signal and the reference clock signal between the clock controller and the source driver in the display system, to display an image by the display system. Meanwhile, in the display system, the data signal is transmitted between the clock controller and the source driver through the encoded signal, and as compared with the data transmission directly using the data signal in the prior art, the amount of data in the encoded signal is small. Hence, for the display system of the present disclosure, it is able to transmit the data with few signal lines between the clock controller and the source driver, to reduce the wiring area on the PCB and reduce the production cost.

Alternatively, when the reference clock signal has a frequency less than a predetermined frequency, as shown in FIG. 7*a*, the display system further includes a pair of signal lines Line1 and Line2 located between the respective source driver 600 and the clock controller 500.

The clock controller 500 is specifically configured to transmit the encoded signal and the reference clock signal to the source driver 600 in electrical connection with the clock controller 500 via the pair of signal lines Line1 and Line2, respectively.

The source driver 600 is specifically configured to receive the encoded signal and the reference clock signal from the clock controller 500 in electrical connection with the source driver 600 via the pair of signal lines Line1 and Line2, respectively. To be specific, the clock controller 500 transmits the encoded signal to the source driver 600 in electrical connection with the clock controller 500 via the signal line Line1, and transmits the reference clock signal to the source driver 600 in electrical connection with the clock controller 500. In other words, for the display system of the present disclosure, merely two signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the display system of this embodiment can reduce the number of lines on the PCB, to reduce the production cost.

Alternatively, in the display system according to an embodiment of the present disclosure, when the reference clock signal has a frequency greater than the predetermined frequency, as shown in FIG. 7*b*, the display system may further include two pairs of signal lines Line 1 and Line 2 as well as Line 3 and Line 4 located between the source driver 600 and the clock controller 500.

The clock controller 500 is specifically configured to package the encoded signal to generate a first set of differential signals, transmit the first set of differential signals to the source driver 600 in electrical connection with the clock controller 500 via a pair of signal lines Line1 and Line2, package the reference clock signal to generate a second set of differential signals, and transmit the second set of differential signals to the source driver 600 in electrical connection with the clock controller 500 via another pair of signal lines Line3 and Line 4.

The source driver 600 is specifically configured to receive the first set of differential signals generated by packaging the encoded signal, which is encoded according to the phase difference between the data signal and the reference clock signal in each cycle, via a pair of lines Line1 and Line2, and unpackage the first set of differential signal to obtain the encoded signal; receive the second set of differential signals generated by packaging the reference clock signal from the clock controller 500 via another pair of signal lines Line3 and Line4, unpackage the second set of differential signals to obtain the reference clock signal. In other words, for the display system of this embodiment, merely four signal lines are required to be provided between the clock controller and the source driver so as to transmit the data signal and the reference clock signal therebetween. However, in the prior art, as shown in FIG. 1, 14 signal lines are required to be provided between the clock controller and the source driver. As compared with the prior art, the display system of this embodiment can reduce the number of lines on the PCB, to reduce the production cost.

According to the methods for transmitting the data in the display system, the clock controller, the source driver and the display system of the present disclosure, the clock controller receives the reference clock signal and the data signal from the external data source, determines the phase difference between the data signal and the reference clock signal in each cycle, encodes the determined phase difference according to the predetermined mapping table between phase differences and encoded signals so as to generate the corresponding encoded signal, and then transmits the encoded signal and the reference clock signal to the source driver. By encoding the phase difference between the data signal and the reference clock signal in each cycle, it is able to use the encoded signal and the reference clock signal to transmit the data signal and the reference clock signal between the clock controller and the source drivers. Meanwhile, as compared with the data signal in the prior art, the amount of data in the encoded signal is relatively small, so it is able to transmit the data with few signal lines arranged between the clock controller and the source drivers, to reduce a wiring area on a PCB and reduce the production cost.

Obviously, a person skilled in the art may make further modifications and variations without departing from the spirit of the present disclosure. If these modifications and variations fall within the scope of the appended claims and the equivalents thereof, the present disclosure is also intended to include these modifications and variations.

What is claimed is:

1. A method for transmitting data in a display system, comprising the steps of:

receiving, by a clock controller in the display system, a reference clock signal and a data signal from an external data source;

determining, by the clock controller, a phase difference between the data signal and the reference clock signal in each cycle;

encoding, by the clock controller, the determined phase difference according to a predetermined mapping to generate a corresponding encoded signal; and transmitting, by the clock controller, the corresponding encoded signal and the reference clock signal to a source driver in the display system, wherein the predetermined mapping predefines a correspondence between the phase difference and the corresponding encoded signal.

2. The method according to claim 1, wherein the predetermined mapping is established by the steps of:

dividing one cycle into $2^N$ equal intervals, N being a positive integer greater than 0; and causing the phase difference in the respective interval to correspond to an encoded signal consisting of N numbers, a plurality of encoded signals corresponding to a plurality of phase differences in a plurality of respective intervals being different from each other.

3. The method according to claim 2, wherein:

the step of dividing one cycle into $2^N$ equal intervals comprises dividing the cycle into 4 equal intervals; and the step of causing the phase difference in the respective interval to correspond to the encoded signal consisting of N numbers comprises:

defining the encoded signal corresponding to the phase difference in a first interval as (0,0);

defining the encoded signal corresponding to the phase difference in a second interval as (0,1);

defining the encoded signal corresponding to the phase difference in a third interval as (1,0); and defining the encoded signal corresponding to the phase difference in a fourth interval as (1,1).

4. The method according to claim 1, wherein the step of transmitting, by the clock controller, the encoded signal and the reference clock signal to the source driver in the display system comprises, in response to the reference clock signal having a frequency less than a predetermined frequency:

transmitting, by the clock controller, the encoded signal and the reference clock signal to the source driver in electrical connection with the clock controller via a pair of signal lines, respectively.

5. The method according to claim 1, wherein the step of transmitting, by the clock controller, the encoded signal and the reference clock signal to the source driver in the display system comprises, in response to the reference clock signal having a frequency greater than a predetermined frequency:

packaging, by the clock controller, the encoded signal to generate a first set of differential signals, transmitting the first set of differential signals to the source driver in electrical connection with the clock controller via a pair of signal lines, packaging the reference clock signal to generate a second set of differential signals, and transmitting the second set of differential signals to the source driver in electrical connection with the clock controller via another pair of signal lines.

6. A method for transmitting data in a display system, comprising:

receiving, by a source driver in the display system, a reference clock signal and an encoded signal encoded according to a phase difference between a data signal and the reference clock signal in each cycle from a clock controller;

decoding, by the source driver, the encoded signal according to a predetermined mapping to generate the phase difference corresponding to the encoded signal;

generating, by the source driver, a data signal according to the phase difference and the reference clock signal; and transmitting, by the source driver, the data signal and the reference clock signal to a data line in the display system, wherein the predetermined mapping predefines a correspondence between the phase difference and the corresponding encoded signal.

7. The method according to claim 6, wherein the step of receiving, by the source driver, the reference clock signal and the encoded signal from the clock controller comprises, in response to the reference clock signal having a frequency less than a predetermined frequency:

receiving, by the source driver, the encoded signal and the reference clock signal from the clock controller in electrical connection with the source driver via a pair of signal lines, respectively.

8. The method according to claim 6, wherein the step of receiving, by the source driver, the reference clock signal and the encoded signal from the clock controller comprises, in response to the reference clock signal having a frequency greater than a predetermined frequency:

receiving, by the source driver, a first set of differential signals generated by packaging the encoded signal, which is encoded according to the phased difference between the data signal and the reference clock signal in each cycle, via a pair of signal lines;

unpackaging the first set of differential signals to obtain the encoded signal;

receiving a second set of differential signals generated by packaging the reference clock signal from the clock controller via another pair of signal lines; and unpackaging the second set of differential signals to obtain the reference clock signal.

9. A display system, comprising a clock controller and at least one source driver, wherein the clock controller is configured to receive a reference clock signal and a data signal from an external data source;

determine a phase difference between the data signal and the reference clock signal in each cycle;

encode the determined phase difference according to a predetermined mapping to generate a corresponding encoded signal; and transmit the encoded signal and the reference clock signal to the source driver;

the source driver is configured to receive the reference clock signal and an encoded signal encoded according to a phase difference between the data signal and the reference clock signal in each cycle from a clock controller;

decode the encoded signal according to the predetermined mapping to generate the phase difference corresponding to the encoded signal;

generate the data signal according to the phase difference and the reference clock signal; and transmit the data signal and the reference clock signal to a data line; and the predetermined mapping predefines a correspondence between the phase difference and the corresponding encoded signal.

10. The display system according to claim 9, further comprising a pair of signal lines located between the respective source driver and the clock controller, wherein in response to the reference clock signal having a frequency less than a predetermined frequency:

the clock controller is configured to transmit the encoded signal and the reference clock signal to the source driver in electrical connection with the clock controller via the pair of signal lines, respectively, and the source driver is configured to receive the encoded signal and the reference clock signal from the clock controller in electrical connection with the source driver via the pair of signal lines, respectively.

11. The display system according to claim 9, further comprising first and second pairs of signal lines located between the respective source driver and the clock controller, wherein in response to the reference clock signal having a frequency greater than a predetermined frequency:

the clock controller is configured to package the encoded signal to generate a first set of differential signals, transmit the first set of differential signals to the source driver in electrical connection with the clock controller via the first pair of signal lines, package the reference clock signal to generate a second set of differential signals, and transmit the second set of differential signals to the source driver in electrical connection with the clock controller via the second pair of signal lines, and the source driver is configured to receive the first set of differential signals generated by packaging the encoded signal, which is encoded according to the phase difference between the data signal and the reference clock signal in each cycle, via the first pair of lines, unpackage the first set of differential signal to obtain the encoded signal, receive the second set of differential signals generated by packaging the reference clock signal from the clock controller via the second pair of signal lines, and unpackage the second set of differential signals to obtain the reference clock signal.

12. The display system according to claim 9, wherein the clock controller comprises:

a first receiving unit configured to receive a reference clock signal and a data signal from an external data source;

a determining unit configured to determine a phase difference between the data signal and the reference clock signal in each cycle;

an encoding unit configured to encode the determined phase difference according to a predetermined mapping to generate a corresponding encoded signal; and a first transmitting unit configured to transmit the encoded signal and the reference clock signal to a source driver.

13. The display system according to claim 12, wherein the clock controller further comprises a storage unit configure to store the predetermined mapping, and wherein the display system is configured to establish the predetermined mapping by the steps of:

dividing one cycle into $2^N$ equal intervals, N being a positive integer greater than 0; and causing the phase difference in the respective interval to correspond to an encoded signal consisting of N numbers, a plurality of encoded signals corresponding to a plurality of phase differences in a plurality of respective intervals being different from each other.

14. The display system according to claim 12, wherein the first transmitting unit is configured to, in response to the reference clock signal having a frequency less than a predetermined frequency:

transmit the encoded signal and the reference clock signal to the source driver in electrical connection with the clock controller via a pair of signal lines, respectively.

15. The display system according to claim 12, wherein the first transmitting unit is configured to, in response to the reference clock signal having a frequency greater than a predetermined frequency:

package the encoded signal to generate a first set of differential signals, transmit the first set of differential signals to the source driver in electrical connection with the clock controller via a pair of signal lines, package the reference clock signal to generate a second set of differential signals, and transmit the second set of differential signals to the source driver in electrical connection with the clock controller via another pair of signal lines.

16. The display system according to claim 9, wherein the source driver comprises:

a second receiving unit configured to receive a reference clock signal and an encoded signal encoded according to a phase difference between a data signal and the reference clock signal in each cycle from a clock controller;

a decoding unit configured to decode the encoded signal according to the predetermined mapping, to generate the phase difference corresponding to the encoded signal;

a generating unit configured to generate a data signal according to the phase difference and the reference clock signal; and a second transmitting unit configured to transmit the data signal and the reference clock signal to a data line.

17. The display system according to claim 16, wherein the second receiving unit is configured to, in response to the reference clock signal having a frequency less than a predetermined frequency:

receive the encoded signal and the reference clock signal from the clock controller in electrical connection with the source driver via a pair of signal lines, respectively.

18. The display system according to claim 16, wherein the second receiving unit is configured to, in response to the reference clock signal having a frequency greater than a predetermined frequency:

receive a first set of differential signals generated by packaging the encoded signal, which is encoded according to the phased difference between the data signal and the reference clock signal in each cycle, via a pair of signal lines, unpackage the first set of differential signals to obtain the encoded signal, receive a second set of differential signals generated by packaging the reference clock signal from the clock controller via another pair of signal lines, and unpackage the second set of differential signals to obtain the reference clock signal.

* * * * *